US007105474B2

(12) United States Patent
Kim et al.

(10) Patent No.: US 7,105,474 B2
(45) Date of Patent: Sep. 12, 2006

(54) ORGANIC STRIPPING COMPOSITION AND METHOD OF ETCHING OXIDE USING THE SAME

(75) Inventors: Tae-Hyun Kim, Suwon-si (KR); Byoung-Moon Yoon, Suwon-si (KR); Kyung-Hyun Kim, Seoul (KR); Chang-Lyong Song, Yongin-si (KR); Yong-Sun Ko, Yongin-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 237 days.

(21) Appl. No.: 10/634,880

(22) Filed: Aug. 6, 2003

(65) Prior Publication Data

US 2004/0038839 A1 Feb. 26, 2004

(30) Foreign Application Priority Data

Aug. 23, 2002 (KR) ..... 2002-50200

(51) Int. Cl.
*C11D 7/50* (2006.01)

(52) U.S. Cl. ..... 510/175; 510/176

(58) Field of Classification Search ..... 510/175, 510/176, 504, 254, 506; 252/79.1, 79.2, 252/79.3, 79.4; 134/2.2; 438/745
See application file for complete search history.

(56) References Cited

U.S. PATENT DOCUMENTS 4,171,242 A 10/1979 Liu
4,410,396 A * 10/1983 Somers et al. ..... 216/109
6,132,522 A * 10/2000 Verhaverbeke et al. ..... 134/26
6,323,169 B1 11/2001 Abe et al.
6,391,793 B1 * 5/2002 Lee et al. ..... 438/745
6,462,005 B1 10/2002 Gotoh et al.
6,794,307 B1 * 9/2004 Chen et al. ..... 438/754

FOREIGN PATENT DOCUMENTS

| | | |
|---|---|---|
| JP | 62-049355 | 3/1987 |
| JP | 64(1)-42653 | 2/1989 |
| JP | 7-201794 | 8/1995 |
| JP | 8-202050 | 8/1996 |
| KR | 2000-55067 | 9/2000 |

* cited by examiner

*Primary Examiner*—Gregory Webb
(74) *Attorney, Agent, or Firm*—Lee & Morse, P.C.

(57) ABSTRACT

Disclosed is an organic stripping composition and a method of etching a semiconductor device in which the generation of an Si pitting phenomenon can be prevented. The composition includes a compound including a hydroxyl ion ($OH^-$), a compound including a fluorine ion ($F^-$) and a sufficient amount of an oxidizing agent to control the pH of the composition within the range of from about 6.5 to about 8.0. The method includes dry etching an oxide by a dry etching using a plasma, and then ashing the etched oxide using an ashing process to remove an organic material. The method further includes supplying the organic stripping composition to remove residues including any residual organic material, a metal polymer, and an oxide type polymer. The stripping composition is stable onto various metals and does not induce the Si pitting phenomenon.

9 Claims, 11 Drawing Sheets

ORGANIC STRIPPING COMPOSITION AND METHOD OF ETCHING OXIDE USING THE SAME

BACKGROUND OF THE INVENTION

1. Field of the Invention

The present invention relates to an organic stripping composition and to an etching method using the same. More particularly, the invention relates to an organic stripping composition to prevent the generation of Si pitting and that effectively removes residues remaining after dry etching and ashing. The invention relates further to a method of etching an oxide using the composition.

2. Description of the Related Art

The design of semiconductor devices has recently made rapid progress as information media such as computers are becoming more popular widely used by the consuming public. In particular, this progress has required semiconductor devices to function at a high operating speed, and to have a large storage capacitance. Semiconductor devices having increased density, reliability, and response time currently are under development in an effort to satisfy such requirements.

The area of a chip increases by about 1.4 times in every three years, while the integration degree of a device increases by about 4 times to gradually reduce pitches between devices in a cell. When the pitch size between devices is reduced, it becomes increasingly difficult to manufacture devices that satisfy the two characteristics of insulation and refresh characteristics.

As the integration degree of semiconductor devices increases in order to increase productivity of chips within a limited area, multi-layered wirings have been developed and gradually minute patterns are formed. As the number of metal processes and via hole forming processes for the manufacture of the multi-layered wirings increases, various selective etching processes by means of a dry etching method are implemented. Photoresist patterns used as a mask during implementation of the dry etching method are removed after the dry etching by an ashing process. After completing the dry etching and the ashing process, various residues from dry etching gases, the photoresist, oxides, conductive thin films, etc. remain on the substrate surface. These residues mainly remain as a polymer and as impurities on a semiconductor device, which can increase the electrical resistance or induce an electric short. Accordingly, various stripping compositions are applied to efficiently remove these residues.

Japanese Patent Laid-Open Publication Nos. Sho 62-49355 and Sho 64-42653, disclose organic amine stripping solutions. These solutions include an alkane amine compound and an organic solvent. These stripping solutions typically are used at a relatively high temperature, however, and they include inflammable organic compounds that are liable to volatilize and are combustible. In addition, a metal film formed on the substrate may be corroded by an alkaline organic amine compound remaining on the substrate after the cleaning process when the substrate is cleaned using the organic amine stripping solution and then rinsed using water without applying an organic solvent such as an alcohol. Therefore, after cleaning the substrate, the substrate usually is rinsed using an organic solvent such as an alcohol.

In order to solve the above-described problem, Japanese Patent Laid-Open Publication Nos. Hei 7-201794 & Hei 8-20205 disclose an aqueous fluorine-based solution including a fluorine compound, an organic solvent, a corrosion inhibitor, etc. This aqueous solution is said to have an improved efficiency in removing residues and can be used at a low temperature.

However, when applying recent etching and ashing conditions, some residues still remain after stripping even when using the above-described organic amine stripping composition and the aqueous fluorine-based solution. The remaining residues increase the resistance of a semiconductor device and sometimes become a factor in forming a discontinuous conductive pattern of the device.

U.S. Pat. No. 6,323,169 issued to Abe et al., discloses a liquid-type resist stripping composition including an antioxidant, a chelating agent, an aqueous fluorine compound and optionally, an organic solvent. This patent alleges that residual resists remaining after etching can be effectively and clearly removed and various defects generated due to the residues can be minimized when applying this composition.

Recently, a fluorine-based organic stripping composition has been widely used. However, even though fluorine is effective for removing a polymer of oxide type, the main component of residues, stripping of other types of polymers is not effective. In addition, since this stripping composition is weakly basic, silicon (Si) might be etched as is the case with other compositions. When an organic stripping composition including fluorine is used, an oxide layer formed on the surface of an undesirably exposed Si by an etching process might be etched. Further, when Si (or Si substrate) is exposed to the stripping composition, Si might be excessively etched to generate a fatal Si pitting defect.

FIG. 1 is a cross-sectional view explaining one of the factors involved in generating an Si pitting defect, taken after implementing an etching process for forming a contact hole. A critical dimension obtained after cleaning inspection (ACI CD) was about 110±10 Å. A silicon nitride layer 14 is formed on a semiconductor substrate 10 that is divided into an active region and a field region by a field oxide layer 12 through an isolation process, and a gate 16 is formed on the active region of the substrate 10. At the side wall portion of the gate 16, a spacer 18 comprising silicon nitride is formed and a silicide layer 20 is formed of CoSi on a predetermined region of the substrate and the gate.

The silicide layer 20 is formed by a salicidation (self aligned silicide) process. Through the salicidation process, silicide regions where the silicide layer is formed can be selectively formed at desired regions. After depositing a metal such as Ti or Co and then heating the deposited metal, Ti-silicide or Co-silicide is formed when silicon atoms are present in the underlying layer. Through a patterning process of a subsequently formed insulation layer to form a contact hole, the silicide layer 20 is exposed. When a metal is deposited onto the exposed silicide layer 20, thus formed metal layer makes an advantageous contact with the silicon containing underlying layer through the medium of the silicide layer 20.

Besides the silicide layer 20, a wiring layer 24 comprising tungsten (W) and a first insulation layer 22 and a second insulation layer 26 (both comprising an oxide) are provided.

After completing an etching process for forming the contact hole, a first contact hole 31 for exposing the tungsten wiring 24, a second contact hole 32 for exposing a silicide layer on the gate and a third and fourth contact hole 33 and 34 for exposing the silicide layer 20 on the substrate are formed. The first, second and third contact holes 31, 32 and 33 are formed properly, however, the fourth contact hole 34 is not properly formed. Through the formation of the fourth contact hole 34, neighboring silicon substrate as well as the silicide layer is exposed as designated by region "A" in FIG. 1. During the formation of a contact hole by an etching process, a deviation of the position of the contact hole, that is, a misalignment, is inevitable, thereby generating the Si pitting problem.

One of the factors involved in generating the Si pitting phenomenon will be described in detail with reference to the above-described method of manufacturing a contact hole. First, a photoresist pattern used as a mask is removed after completing a dry etching process using gas plasma. In order to remove the photoresist pattern, two steps of an ashing process typically are employed: (i) one using oxygen; and (ii) the other using a stripping process using an aqueous alkaline solution. In detail, after anisotropically etching an insulation layer of an oxide by a dry etching, the photoresist pattern formed as the mask is removed through the ashing process. Through the ashing process, the photoresist of an organic polymer is evaporated under an oxygen plasma atmosphere as CO and $CO_2$ through combustion. When a voltage of a high frequency is applied to an electrode in a chamber, an ashing gas plasma is produced. An activated ion of the plasma and material on the surface of the substrate are reacted with each other to evaporate the photoresist. After that, the substrate is treated using the stripping composition and then rinsed to remove residues to complete the etching process.

Most of the residual material remaining after the etching and ashing process is in the form of an oxide type polymer. In order to remove the oxide type polymer, an organic stripping composition is used. A fluorine-based organic stripping composition has recently been widely used as the stripping composition to improve the stripping property of the oxide type polymer as described above. However, since this composition is weakly basic, Si is etched by this composition with other chemical components. Accordingly, when the Si substrate is exposed to the stripping composition, Si is excessively etched to generate the fatal Si pitting defect.

FIGS. 2A and 2B are cross-sectional views that correspond to scanning electron microscope (SEM) pictures for comparing two Si substrates, wherein FIG. 2A is obtained when an Si pitting is not generated and FIG. 2B is obtained when an Si pitting is generated. After an oxide layer 22 is dry etched to form a contact hole, an ashing process and a cleaning process using an organic stripping composition are executed. When an amine-based stripping composition which does not contain fluorine is used as the stripping composition, a contact hole 30 including no Si pitting defect is formed as shown in FIG. 2A. However, when a basic stripping composition containing fluorine is used as the stripping composition, a contact hole 30 including an Si pitting defect is formed to generate a defect on a silicon substrate 10 as shown in FIG. 2B.

When the conventionally applied cleaning process using sulfuric acid that does not contain fluorine is used, the Si pitting is not generated. However, a defect is generated on an exposed tungsten (W) surface. For the manufacture of a device in which W is not exposed, the cleaning process using sulfuric acid usually can be applied. However, according to the trend of the manufacture of a semiconductor device having a high integration and a multi-layered structure, it is desirable to develop a unitary stripping composition that does not cause harm to almost all of the materials used, and that can be used in nearly all types of stripping processes.

The description herein of certain advantages and disadvantages of known compositions, and methods of their use, is not intended to limit the scope of the present invention. Indeed, the present invention may include some or all of the methods and chemical compositions described above without suffering from the same disadvantages.

SUMMARY OF THE INVENTION

The present invention has been made to solve one or more of the aforementioned problems. A feature of the invention therefore is to provide a novel organic stripping composition that can effectively remove oxide polymer residues, can prevent an Si pitting phenomenon and does not harm various materials including metal.

Another feature of an embodiment of the present invention is to provide an etching method using the above-mentioned organic stripping composition in order to manufacture a semiconductor device, whereby the method does not substantially cause the Si pitting defect.

To accomplish these and other features of various embodiments of the invention, there is provided an organic stripping composition comprising a compound including a hydroxyl ion ($OH^-$), a compound including a fluorine ion ($F^-$) and a sufficient amount of an oxidizing agent to control the pH of the composition to within the range of from about 6.5 to about 8.0.

An additional feature of an embodiment of the present invention is accomplished by a method for etching a semiconductor including first etching an oxide by a dry etching process using a plasma. The method further includes ashing the etched oxide material to remove any residual organic material. The method continues by stripping the ashed and etched oxide material to remove residues including any residual organic material, any metal polymer and any oxide polymer by applying to the material an organic stripping composition. The organic stripping composition comprises a compound including a hydroxyl ion ($OH^-$), a compound including a fluorine ion ($F^-$) and a sufficient amount of an oxidizing agent to control the pH of the composition to within the range of from about 6.5 to about 8.0.

In particular, the method preferably is applied when an Si layer is exposed by the etching process. More preferably, this method is applied when one layer such as W, Al, Ti, TiN and CoSi layer is exposed by the etching process.

Even though an organic stripping composition containing fluorine ion and hydroxyl ion is good in removing residues remaining after implementing a dry etching and ashing process, Si pitting phenomenon might be induced when an Si substrate is exposed. In order to solve this problem, an oxidant is added into the composition in accordance with the present invention to readily oxidize an exposed Si component.

BRIEF DESCRIPTION OF THE DRAWINGS

The above and other features and advantages of the present invention will become readily apparent by reference to the following detailed description when considered in conjunction with the accompanying drawings wherein:

FIGS. 2A and 2B are cross-sectional views corresponding to SEM pictures for comparing two Si substrates, wherein FIG. 2A is obtained when an Si pitting is not generated and FIG. 2B is obtained when an Si pitting is generated;

DETAILED DESCRIPTION OF THE PREFERRED EMBODIMENT

This application claims priority to Korean priority application No. 2002-50200, filed on Aug. 23, 2002, the disclosure of which is incorporated by reference herein in its entirety. Hereinafter, the embodiments of the present invention will be described in detail.

The present invention relates to an organic stripping composition, and to methods of using the stripping composition to etch a semiconductor. The stripping composition comprises a compound including a hydroxyl ion ($OH^-$), a compound including a fluorine ion ($F^-$), and a sufficient amount of an oxidizing agent to control the pH of the composition to within the range of from about 6.5 to about 8.0.

In particular, the preferred oxidizing agent is nitric acid ($HNO_3$) and the pH of the composition preferably is in a range of from about 6.5 to about 7.0. Other preferred oxidizing agents besides nitric acid include hydrogen peroxide ($H_2O_2$), peroxonitric acid ($HNO_4$), peroxophosphoric acid ($H_3PO_5$), peroxosulfuric acid ($H_2SO_5$), and mixtures thereof. Typically, the composition includes acetic acid, ammonium hydroxide, hydrogen fluoride and the oxidizing agent and has a pH value in a range of from about 6.5 to about 7.0.

In addition, the preferred amount of the compound including the fluorine ion is in a range of about 0.0001–50% by weight, more preferably in a range of about 0.0001–1% by weight, based on the total amount of the composition. When the composition includes acetic acid, ammonium hydroxide and hydrogen fluoride, the preferred amount of these compounds is in a range of about 2–15% by volume based on the total volume of the composition. More preferably, the etching selectivity of the composition onto an oxide polymer with respect to materials such as Si, W, Al, Ti, TiN and CoSi is in a range of about 50:1–4:1.

Figure 3A:
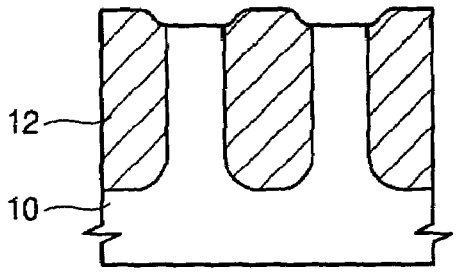
FIG.3A (PRIOR ART)
FIGS. 3A to 3C are cross-sectional views corresponding to SEM pictures for illustrating an etched amount of silicon substrates taken after dipping silicon substrates into a conventionally used basic organic stripping composition including fluorine.
Figure 3B:
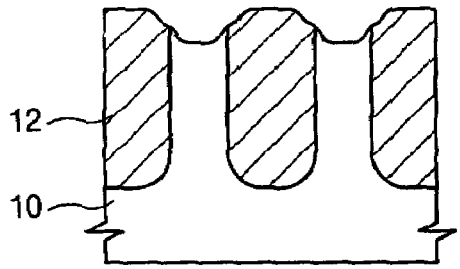
FIG.3B (PRIOR ART)
Figure 3C:
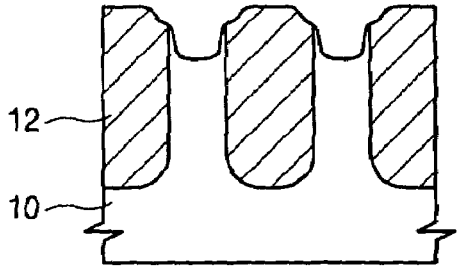
FIG.3C (PRIOR ART)

FIGS. 3A to 3C are cross-sectional views corresponding to SEM pictures for illustrating an etched amount of silicon substrates taken after dipping silicon substrates into a conventionally used basic organic stripping composition including fluorine. FIG. 3A corresponds to an SEM picture obtained after dipping the silicon substrate into the stripping composition for 8 minutes. FIG. 3B corresponds to an SEM picture obtained after dipping the silicon substrate into the stripping composition for 16 minutes, and FIG. 3C corresponds to an SEM picture obtained after dipping the silicon substrate into the stripping composition for 32 minutes.

The applied stripping composition was NE200 (trade name purchased from Ashland Co. Ltd.) and included about 75–85% by volume of alkyl amine such as dimethylacetamide (DMAC) ($NH_2CH_2CH_2OCH_2CH_2OH$) and about 5–15% by volume of water as main components. The composition also included about 2–15% by volume of acetic acid, ammonium hydroxide and hydrofluoric acid as functional components and additives. This composition had an effective removing property onto oxide residues.

Among the components constituting the composition, ammonium hydroxide is believed to be responsible for removing a metal polymer and the fluorine ion is believed to be responsible for removing an oxide polymer. This type of fluorine-based organic stripping composition has a good removing property of the oxide polymer when compared with the conventional amine-based stripping composition. This composition is basic and the pH of this composition was about 8.0.

When comparing the three drawings of FIGS. 3A, 3B and 3C, the etched amount of an active region of a silicon substrate, that is, the depth of the etched portion, increases in line with the lapse of time. The etched amounts are illustrated in the following Table 1.

TABLE 1

| Dipping time | 8 min. | 16 min. | 32 min. |
|---|---|---|---|
| Etched amount | 110 Å | 230 Å | 550 Å |

From the result illustrated in Table 1, it can be noted that the etched amount of Si is proportional to the dipping time into the stripping composition. This result means that a certain component in the composition continuously is reacted with Si to dissolve the Si component out. In order to prevent the silicon pitting phenomenon, the cause and mechanism of this phenomenon was examined in more detail.

Figure 4A:
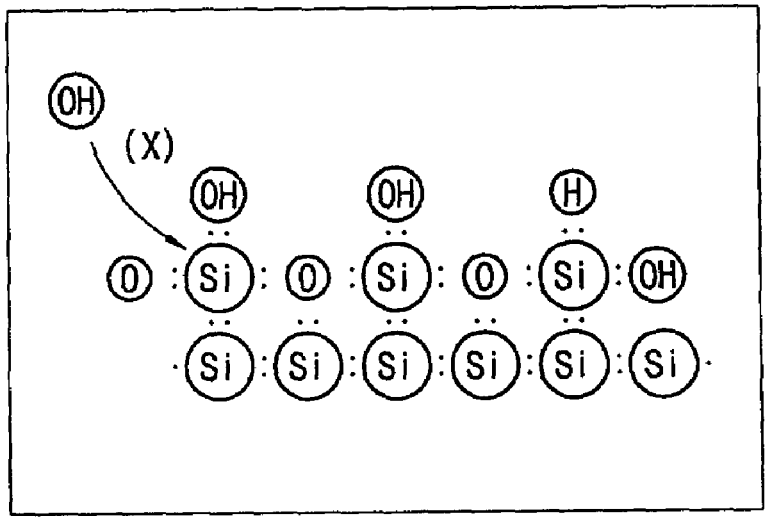
FIG.4A (PRIOR ART)
FIGS. 4A and 4B are chemical reaction diagrams for explaining an etching mechanism of an Si substrate when dipped into a stripping composition excluding fluorine (FIG. 4A) and a stripping composition including fluorine (FIG. 4B) according to a conventional method.
Figure 4B:
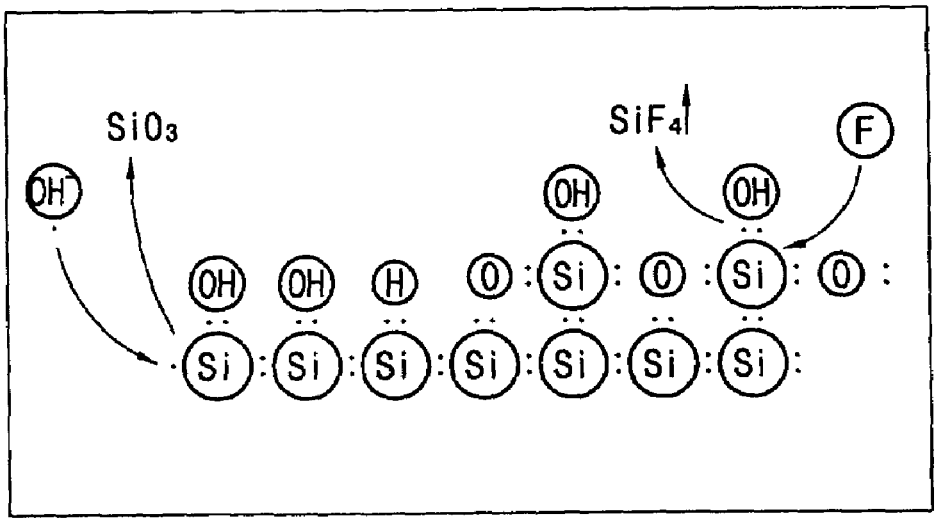
FIG.4B (PRIOR ART)

FIGS. 4A and 4B are chemical reaction diagrams for explaining an etching mechanism of an Si substrate when the Si substrate is dipped into a stripping composition excluding fluorine (FIG. 4A) according to a conventional method and a stripping composition including fluorine (FIG. 4B). The reaction illustrated in FIG. 4A corresponds to a reaction mechanism at the surface portion of a silicon substrate when EKC (trade name purchased from EKC Co. Ltd.) was used as an amine-based organic stripping composition. The reaction illustrated in FIG. 4B corresponds to a reaction mechanism at the surface portion of a silicon substrate when NE200 was used as a fluorine-based stripping composition.

Referring to FIG. 4A, first, the EKC stripping composition contains $HN_2OH$, $NH_2O(C_2H_4)_2OH$, additives, etc. but does not contain fluorine ions. When an Si substrate is exposed after completing a plasma etching process using dry etching gas having a predetermined etching selectivity with respect to an oxide, and the substrate is subjected to ashing, the inner portion of the substrate includes only Si bonds but the surface portion of the substrate includes oxygen, hydrogen, hydroxyl functional group, etc. by an oxidation reaction, as shown in FIG. 4A. When the substrate is dipped into the EKC stripping composition, the hydroxyl functional group in the composition, which has a good reactivity, makes contact with the surface portion of the substrate. Here, the hydroxyl ion cannot make contact with Si atoms because these Si atoms are protected by other atoms, especially by oxygen atoms that are bonded at the surface portion of the substrate. Therefore, the Si pitting phenomenon is not generated.

However, when the substrate is dipped into the NE200 stripping composition, Si dissolves out by the function illustrated in FIG. 4B. This mechanism will be explained in sequence referring to the following reaction equations (1)–(3).

$$CH_3COOH+NH_4OH+HF \leftrightharpoons CH_3COOH+CH_3COONH_4+NH_4F \quad (1)$$

$$SiO_2+4HF \leftrightharpoons SiF_4\uparrow+2H_2O\uparrow \quad (2)$$

$$Si+6OH^- \rightarrow SiO_3^{-2}+3H_2O,\ E=1.7V \quad (3)$$

First, the NE200 stripping composition contains acetic acid, ammonium hydroxide and hydrogen fluoride and has a basic property while keeping an equilibrium as illustrated in reaction equation (1). Within the NE200 stripping composition, the hydroxyl anions and the fluoride anions are present simultaneously. When the Si substrate is exposed after completing the plasma etching process onto the oxide and the ashing process, the inner portion of the substrate includes only Si bonds, but the surface portion of the substrate includes oxygen, hydrogen, hydroxyl functional group, etc. by an oxidation, as illustrated in FIG. 4A.

When the substrate is dipped into the NE200 stripping composition, an $SiO_2$ layer at the surface portion is firstly removed by the fluoride anion as illustrated in reaction equation (2). Once the $SiO_2$ layer is removed, the underlying Si atoms are exposed to the hydroxyl anions and then are readily reacted with the hydroxyl anions to be dissolved out in the $SiO_3^{-2}$ form. Through this reaction mechanism, the Si pitting phenomenon is generated within the basic composition including fluorine ions.

That is, the silicon oxide layer is removed by the fluorine ions contained in the composition and thus exposed Si is advantageously etched by the hydroxyl ions afterward. Accordingly, the inventors of the present invention perceived that the etching of the Si by the hydroxyl anions might be prevented if the exposed Si component can be oxidized in a short time even though the silicon oxide layer is removed by the fluorine ions and accomplished in the present invention.

The exposed Si component can be oxidized by a stripping composition prepared by adding an appropriate amount of an oxidizing agent into a stripping composition containing the hydroxyl ions and the fluorine ions. When the substrate is dipped into thus prepared stripping composition, the $SiO_2$ layer formed at the surface portion of the substrate is removed by the fluorine ions, thereby exposing the Si component. After that, the exposed Si component is readily oxidized by the added oxidizing agent to form silicon oxide and the etching reaction by the hydroxyl anions is retarded.

At this time, thus formed silicon oxide also is dissolved out by the fluorine ions to expose the underlying Si component. Once the Si component is exposed, the dissolving reaction by the hydroxyl ions proceeds. The amount of the compound including the fluorine ion is not limited to a certain range. However, the preferred amount of this compound is in a range of about 0.0001–50% by weight based on the total weight of the composition when considering an effect obtainable through the addition of the oxidizing agent. Since the etching rate of the silicon oxide layer by the fluorine ions is very fast when the amount of the compound including the fluorine ion is in the range of about 1% or over by weight based on the total amount of the composition, the exposed silicon might be readily oxidized by the oxidizing agent to obtain an effective etching retarding effect.

When a trace amount of the compound including the fluorine ion is included in the organic stripping composition of the present invention, within a range of about 0.0001–1% by weight based on the total amount of the composition, the etching reaction of the silicon oxide by the fluorine ions proceeds very slowly. Accordingly, the reaction (2) occurring at the surface portion of the oxidized silicon substrate is very slow when compared to the reaction (3) due to the addition of the oxidizing agent. Ultimately, the slow reaction (2) functions to prevent the dissolution of the silicon oxide.

Figure 1:
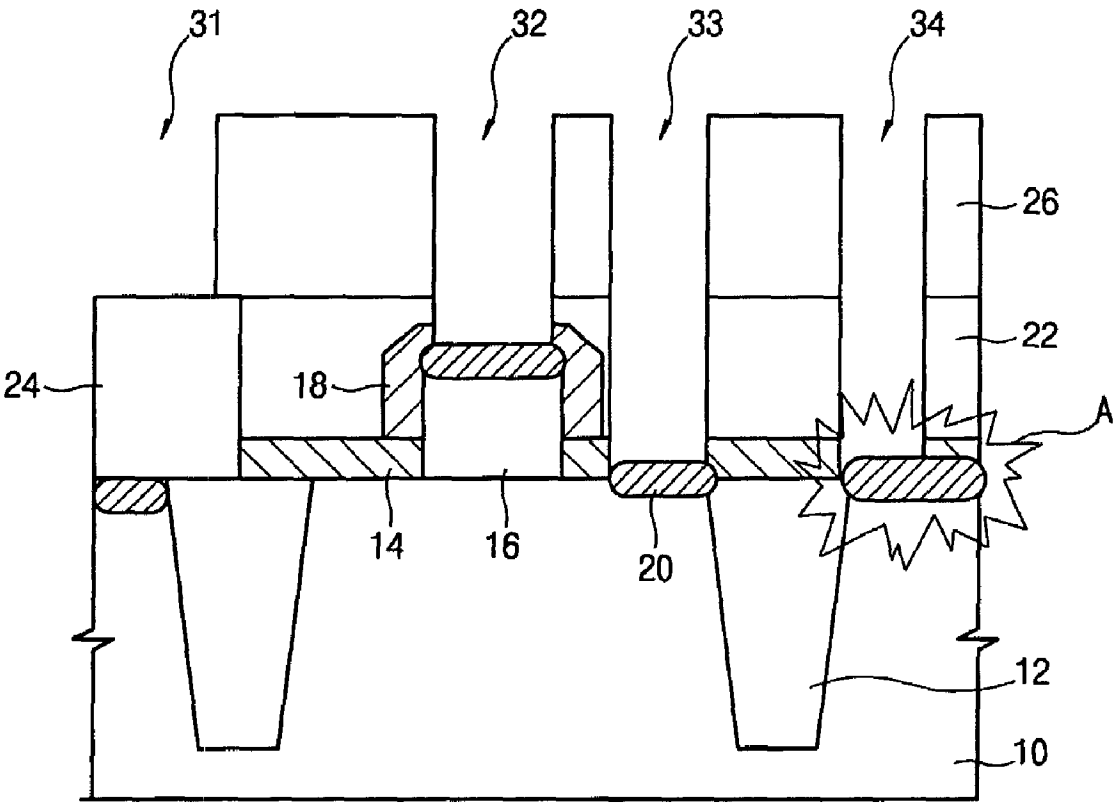
FIG. 1 (PRIOR ART)
FIG. 1 is a cross-sectional view taken after implementing an etching process for forming a contact hole that is useful in explaining one of the factors involved in generating an Si pitting defect.
Figure 2A:
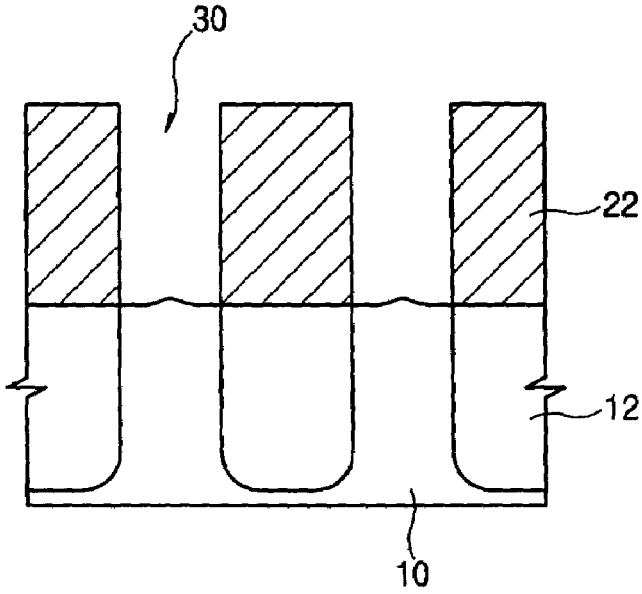
FIG.2A (PRIOR ART)
Figure 2B:
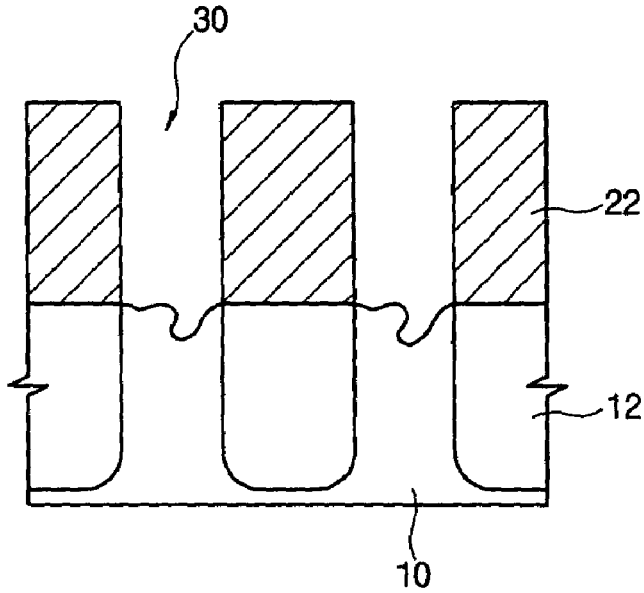
FIG.2B (PRIOR ART)

As described above, the etching of the Si substrate could be prevented by applying the stripping composition prepared by adding the oxidizing agent such as nitric acid based on the above-described reaction mechanism. However, various types of materials including some metals also are exposed by recently applied etching process, as illustrated in FIG. 1. Thus, the stability of the stripping composition onto the various materials used for the manufacture of semiconductor devices also should be considered. In order to examine the stability of the stripping composition onto various materials, the pH change of the stripping composition according to an added amount of nitric acid and etching characteristics of the various materials at each pH range were observed.

Figure 5:
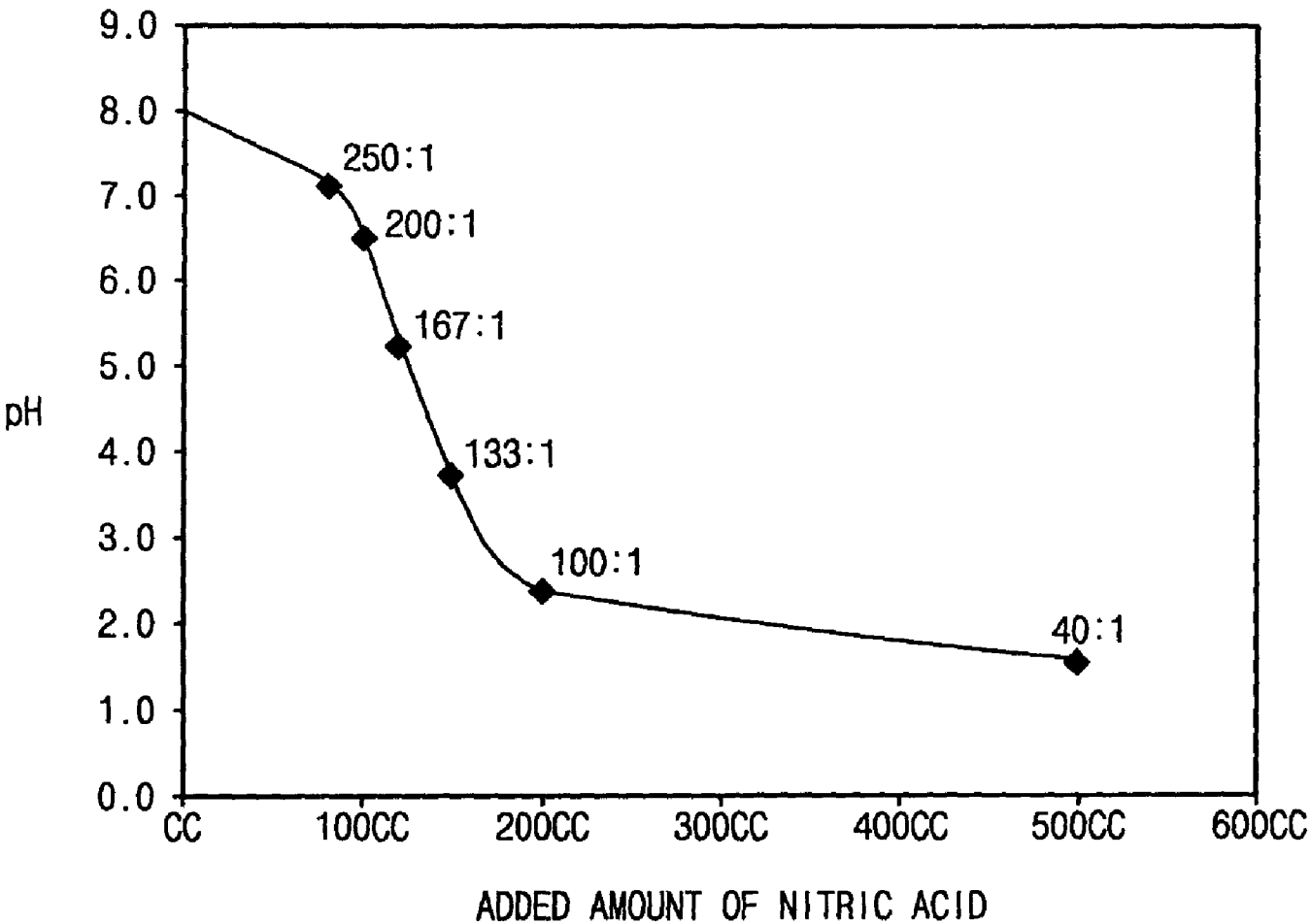
FIG. 5 is a graph illustrating a change of pH according to an added amount of nitric acid into an organic stripping composition.

FIG. 5 is a graph illustrating a change of pH according to an added amount of nitric acid in an organic stripping composition. The added amount of nitric acid is measured by the cubic centimeters (cc) units and numerals designated on graph represent the mixing ratio of nitric acid with NE200 by volume. Since NE200 is a basic composition of which the pH is about 8 and nitric acid is a strong acid, the pH of the composition is largely lowered by the addition of even a small amount of nitric acid. The organic stripping composition including nitric acid prepared by mixing NE200 and nitric acid in a mixing ratio of about 200:1–250:1 by volume is neutral or basic. When the added amount of nitric acid exceeds the above range, the stripping composition becomes acidic.

FIGS. 6 to 9 are graphs illustrating the etching characteristics of various materials according to a change of the pH of an organic stripping composition including nitric acid. The etched amount of each material is measured after dipping each material into the stripping composition having a few pH values for 8 minutes.

Figure 6:
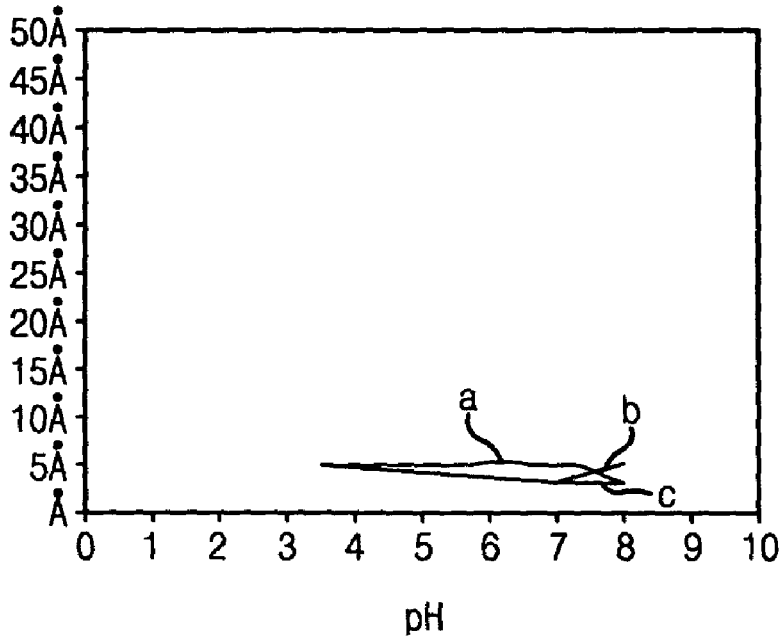
FIGS. 6 to 9 are graphs illustrating etching characteristics of various materials according to a change of pH of an organic stripping composition.

FIG. 6 illustrates the etching characteristics of TiN, W and CoSi, in which graph a corresponds to TiN, graph b corresponds to W, and graph c corresponds to CoSi. Referring to FIG. 6, the etched amount of these metal components is in the range of 5 Å or less over the pH range of about 3.5–8. This result means that these metal components are very stable and are relatively independent from the pH value of the stripping composition.

Figure 7:
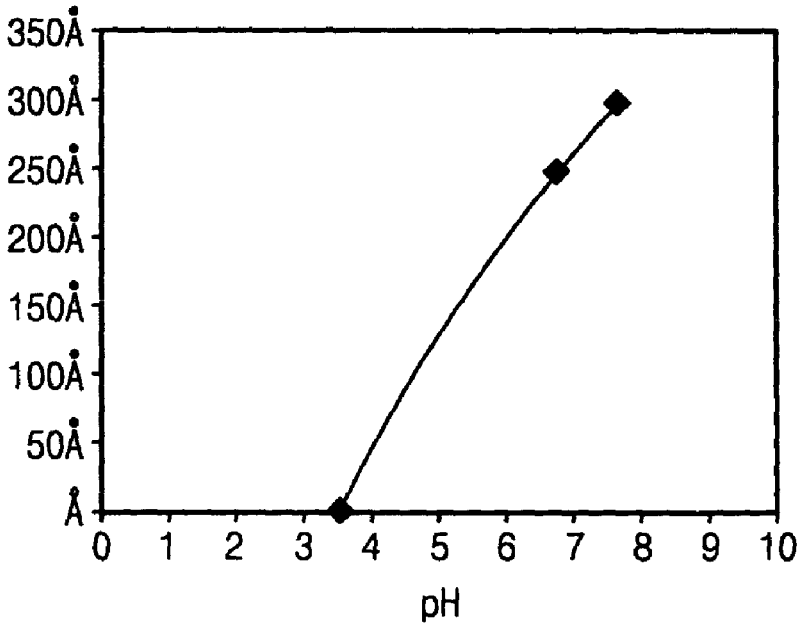

FIG. 7 illustrates the etching characteristic of a field oxide. The etched amount of the field oxide largely increases in proportional to the pH value. Referring to these results, the organic stripping composition of the present invention has a good removing property of an oxide. In particular, the etching characteristic onto the oxide becomes even better when the basicity of the composition becomes strong.

Figure 8:
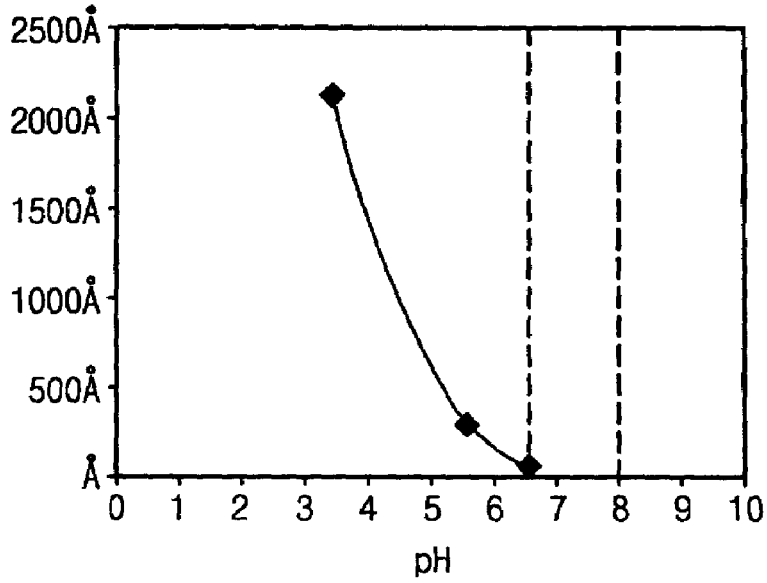

FIG. 8 illustrates the etching characteristic of Al. Aluminum is known to be corroded in a composition of acidic range. Therefore, the pH of the stripping composition should be appropriately controlled considering this characteristic. Referring to FIG. 8, the etching of aluminum occurs actively when the acidity of the composition is strong. However, in the neutral or basic composition of which pH range is about 6.5–8, the etching upon aluminum hardly occurs.

Figure 9:
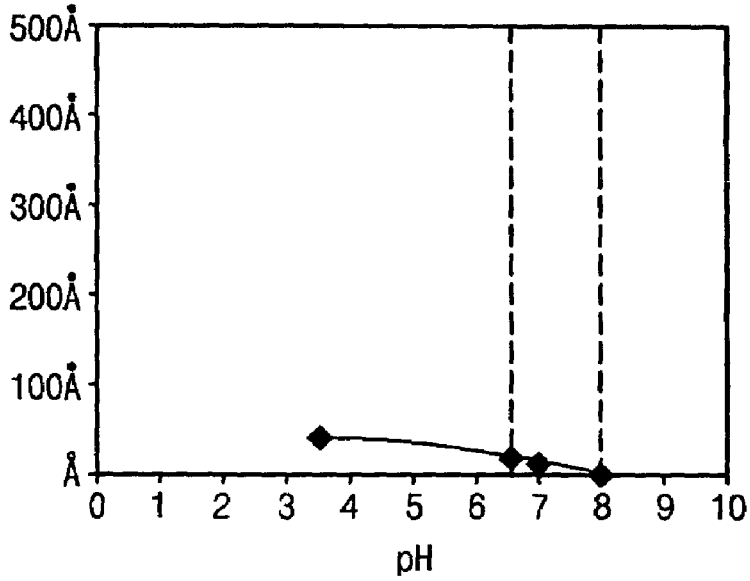

FIG. 9 illustrates the etching characteristic of Ti. From the result illustrated in FIG. 9, a trace amount of Ti is etched in an acidic composition, however, almost no Ti is etched in an basic composition. Ti is regarded as being relatively stable over almost all the pH range.

The observed results of the etching characteristics of aluminum and titanium, which attain much concern by the present inventors, are illustrated in Table 2 according to the pH range of the stripping composition.

TABLE 2

| pH | 8.0 | 7.0 | 6.5 | 3.5 |
|---|---|---|---|---|
| Ti etched amount (Å) | 2 | 10 | 13 | 65 |
| Al etched amount (Å) | 37 | 47 | 60 | 2000 or over |

Referring now to Table 2, the etched amount of the two components is small in a composition that is neutral or basic, i.e. at the range of pH 6.5 or over. The fluorine-based stripping composition prepared by adding the oxidizing agent according to the present invention has a good stripping property onto the oxide, while is stable within an appropriate pH range for various components.

The stability of the stripping composition including the oxidizing agent onto Si will be examined below. This experiment was executed for patterns formed on an Si substrate. In addition, the stability onto aluminum pattern also was executed.

Figure 10A:
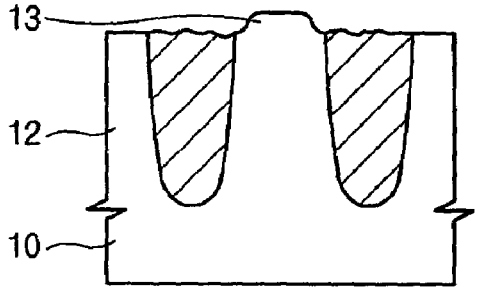
FIGS. 10A to 10C are cross-sectional views corresponding to SEM pictures for observing an etching characteristic of a stripping composition onto an Si substrate before and after dipping treatment.
Figure 10B:
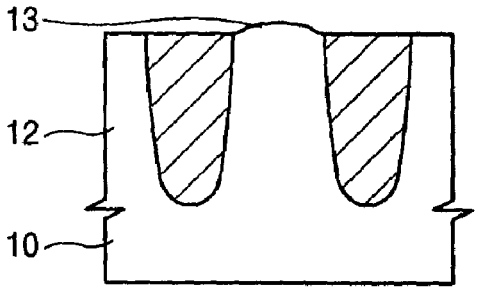
FIG.10B (PRIOR ART)
Figure 10C:
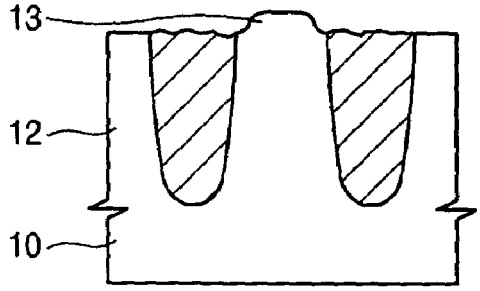

FIGS. 10A to 10C are cross-sectional views corresponding to SEM pictures for observing an etching characteristic of a stripping composition onto an Si substrate before and after dipping treatment. FIG. 10A corresponds to an SEM picture obtained before treating the Si substrate, FIG. 10B corresponds to an SEM picture obtained after treating the Si substrate with the conventional NE200 stripping composition for 8 minutes, and FIG. 10C corresponds to an SEM picture obtained after treating the Si substrate with the stripping composition of the present invention for 8 minutes. The stripping composition of the present invention was obtained by mixing NE200 and nitric acid in a mixing ratio of about 200:1 by volume and had a pH value of about 6.5.

When comparing FIGS. 10A to 10C with each other, the following can be noted. Most of the Si pattern 13 is etched when the substrate is dipped into the conventional NE200 stripping composition by the function of the fluorine ions and hydroxyl ions, as illustrated in FIG. 10B. However, most of Si pattern remains in its original form when the substrate is dipped into the stripping composition of the present invention, which is believed to be due to the function of the oxidizing agent, as illustrated in FIG. 10C.

Figure 11A:
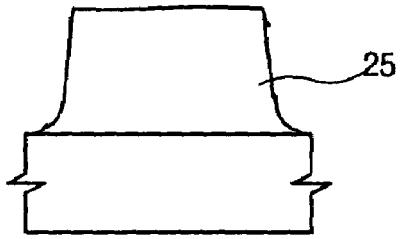
FIGS. 11A to 11C are cross-sectional views corresponding to SEM pictures for observing an etching characteristic of a stripping composition onto an aluminum pattern before and after dipping treatment.
Figure 11B:
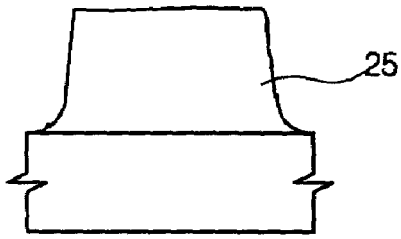
FIG.11B (PRIOR ART)
Figure 11C:
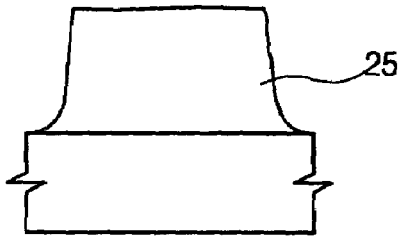

FIGS. 11A to 11C are cross-sectional views corresponding to SEM pictures for observing the etching characteristics of a stripping composition onto an aluminum pattern before and after implementing a dipping treatment. FIG. 11A corresponds to an SEM picture obtained before treating the aluminum pattern, FIG. 11B corresponds to an SEM picture obtained after treating the aluminum pattern with the conventional NE200 stripping composition for 8 minutes, and FIG. 11C corresponds to an SEM picture obtained after treating the aluminum pattern with the stripping composition of the present invention for 8 minutes. The stripping composition of the present invention for obtaining the result illustrated in FIG. 11C was prepared by mixing NE200 and nitric acid in a mixing ratio of about 200:1 by volume and had a pH value of about 6.5.

When comparing FIGS. 11A to 11C with each other, most of aluminum pattern 25 remains in its original form when the substrate was dipped into both the conventional NE200 stripping composition and the stripping composition of the present invention. This result is obtainable since the applied stripping compositions are neutral or basic, although the etched amount of aluminum largely depends on the pH value.

Meantime, in order to confirm the stability of aluminum in the fluorine-based stripping composition containing the oxidizing agent over each pH value, three aluminum patterns were dipped into three stripping compositions of different pH values, respectively, for 8 minutes. After the dipping treatment, the obtained patterns are illustrated in FIGS. 12A to 12C as cross-sectional views.

Figure 12A:
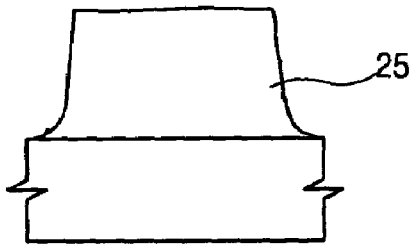
FIGS. 12A to 12C are cross-sectional views corresponding to SEM pictures obtained after dipping an aluminum pattern into a stripping composition having three different pH range for 8 minutes.
Figure 12B:
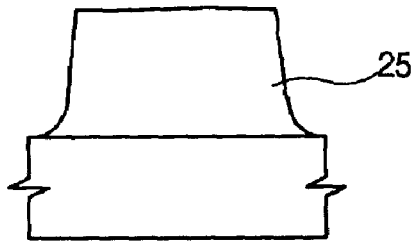
Figure 12C:
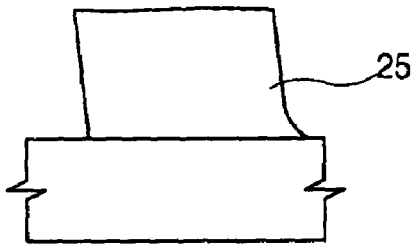

FIGS. 12A to 12C are cross-sectional views corresponding to SEM pictures obtained after dipping an aluminum pattern into a stripping composition having three different pH values for 8 minutes. FIG. 12A corresponds to an SEM picture obtained when using a basic stripping composition, that is, NE200 having a pH range of about 7.0–8.0, FIG. 12B corresponds to an SEM picture obtained when using a stripping composition prepared by mixing NE200 and nitric acid in a mixing ratio of about 200:1 by volume and having a pH value of about 6.5, and FIG. 12C corresponds to an SEM picture obtained when using an acidic stripping composition prepared by mixing NE200 and nitric acid in a mixing ratio of about 133:1 by volume and having a pH value of about 3.5–6.0.

From the drawings, the aluminum patterns 25 are relatively stable in the neutral and basic composition without any corrosion. However, a large amount of the aluminum pattern 25 is corroded in the acidic composition shown in FIG. 12C.

Figure 13:
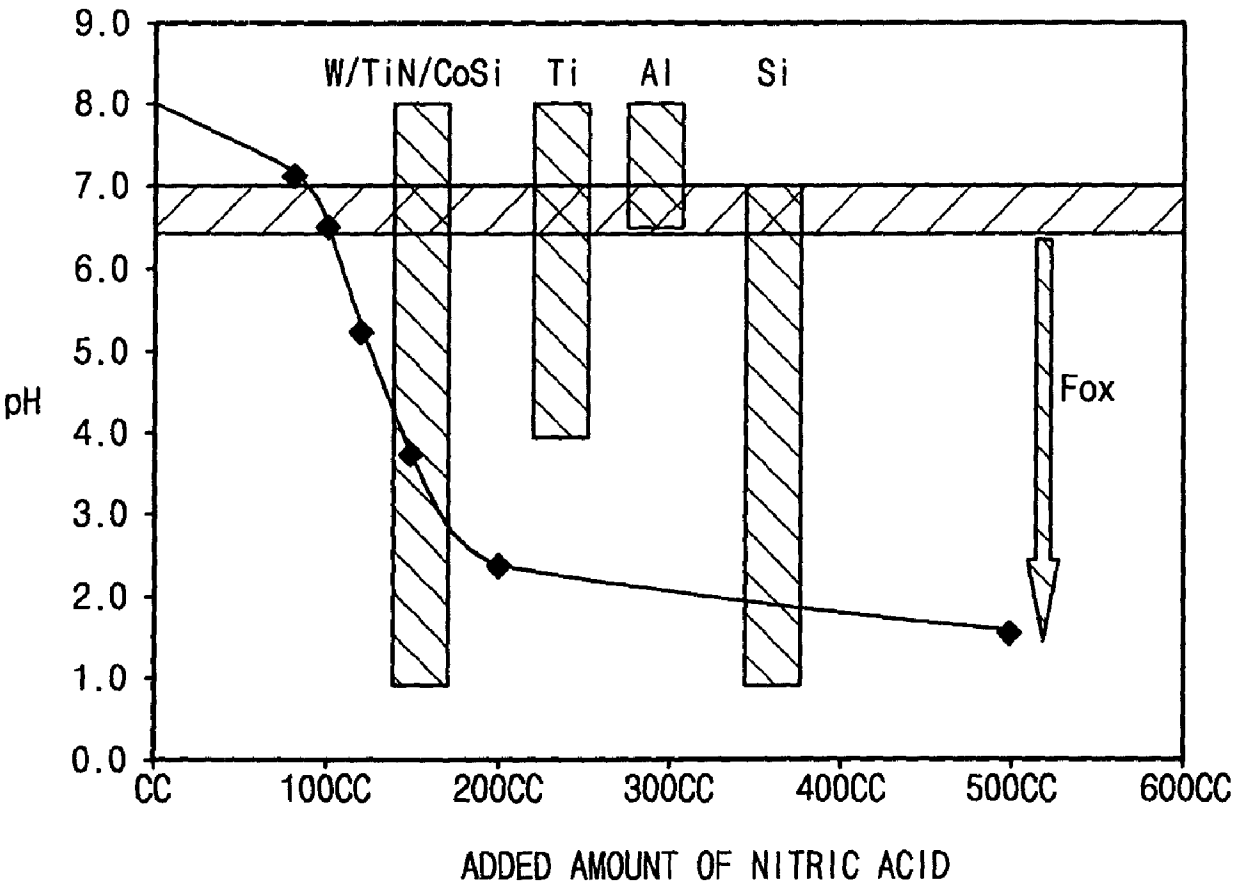
FIG. 13 is a graph illustrating an applicable pH range of a stripping composition for each component according to an added amount of nitric acid.

FIG. 13 is a graph illustrating applicable pH ranges of a stripping composition for each component according to an added amount of nitric acid. Referring to FIG. 13, W, TiN, CoSi, etc. are applicable over almost all pH ranges, Ti is applicable at the pH range of about 4.0–8.0, Al is applicable at the pH range of about 6.5–8.0, and Si is applicable at the pH range of about 7.0 or less. The maximum pH value is set to 8.0 because the pH of NE200 is about 8.0, and that of a composition obtained by adding an oxidizing agent into NE200 will be less than 8.0. In addition, the etching onto the oxide is applicable over almost all pH ranges.

When considering only Si, the stripping composition having a low pH value is desirable, while the stripping composition having a high pH value is desirable when considering various metals. Accordingly, when considering the stable region of some materials, especially aluminum and Si, the preferred pH value of the stripping composition of the present invention is in the range of about 6.5–7.0.

According to the above-described example, nitric acid was used as the oxidizing agent, however, any oxidizing agent other than nitric acid, which can oxidize the surface exposing Si can be used without exception. In particular, since peroxonitric acid ($HNO_4$) has a stronger oxidizing power than nitric acid, an effective result is expected when even a small amount of peroxonitric acid is added for the preparation of the stripping composition of the present invention. That is, since peroxonitric acid has a sufficiently strong oxidizing property at the higher pH range, the pH range of about 6.5–8.0 of thus prepared composition can be kept with a smaller amount of peroxonitric acid when comparing with the added amount of nitric acid. Therefore, the exposed Si can be oxidized faster when peroxonitric acid is used when comparing with the composition using nitric acid.

In the meantime, since W metal is dissolved into hydrogen peroxide, a stripping composition including hydrogen peroxide as the oxidizing agent should not be applied for a process during which W metal is exposed.

According to the present invention, an oxidizing agent is added into a fluorine-based organic stripping composition having a pH value within the range of about 8.0. However, a fluorine-based organic stripping composition having a pH value of higher than 8.0 is more advantageous. In this case, the pH value of thus prepared stripping composition is maintained in a range of from about 6.5 to about 8.0 with an increased amount of the oxidizing agent, and consequently, an even better oxidizing property is obtainable. When an oxidizing agent having a higher oxidizing power is used, a sufficiently high oxidation property can be provided with a smaller amount to produce a stripping composition having a higher pH value.

According to the preferred embodiments of the present invention as described-above, the basic fluorine-based organic stripping composition is prepared by adding the oxidizing agent into a composition having a pH value of about 8.0. Therefore, the pH value of thus prepared stripping composition is less than about 8.0. However, the stripping composition of the present invention also can be prepared by adding the oxidizing agent into the conventional stripping composition of which pH value is higher than 8.0. Here, a sufficient effect of preventing Si pitting could be accomplished with a small amount of a strong oxidizing agent. Further, the pH value of thus prepared stripping composition might be higher than 8.0.

As described above, the fluorine-based organic stripping composition of the present invention is capable of removing an oxide polymer and prevents the generation of Si pitting phenomenon. Further, the stripping composition is stable onto various materials. Accordingly, the stripping composition of the present invention is advantageously applied for any stripping processes after completing almost all of etching processes for manufacturing a semiconductor device. When employing the stripping composition of the present invention, unification of the stripping composition is possible for various types of stripping processes.

In addition, the stripping composition of the present invention can be appropriately used for removing residues remaining after implementing the etching processes when various materials and metals such as Si, W, CoSi, Ti, TiN, Al, etc. are exposed for the manufacture of the semiconductor device. This result means that the stripping composition of the present invention can be advantageously used for the manufacture of recently developed semiconductor devices having a more complicated and minute structure.

Further, the organic stripping composition of the present invention has an improved polymer removing property. Generally, an underlying Ti/TiN layer is exposed after implementing a dry etching for forming a via hole. After completing the dry etching process, metal oxide residues remain. When a stripping process using the stripping composition of the present invention is implemented, the residual metal oxide changes into metal hydroxide to be dissolved out and removed. Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. An organic stripping composition comprising a first compound including a hydroxyl ion ($OH^-$), a second compound including a fluorine ion ($F^-$) and a sufficient amount of nitric acid and a mixture of:

75–86% by volume of dimethylacetamide;

5–15% by volume of water; and

2–15% by volume of acetic acid, ammonium hydroxide, and hydrofluoric acid, wherein the ratio of nitric acid to the mixture ranges from about 1:200 to about 1:250, to control the pH of the composition within the range of from about 6.5 to about 8.0, and wherein the organic stripping composition removes remaining residues after dry etching and/or ashing and prevents pitting of an Si layer and/or damage to a layer including at least one material selected from the group consisting of W, Al, Ti, TiN, and CoSi.

2. The organic stripping composition as claimed in claim 1, wherein the pH of the composition is within the range of from about 6.5 to about 7.0.

3. The organic stripping composition as claimed in claim 1, wherein the amount of hydrofluoric acid is within the range of from about 0.0001 to about 1% by weight, based on the total weight of the composition.

4. The organic stripping composition as claimed in claim 1, wherein an etching selectivity of the composition onto an oxide type polymer with respect to at least one material selected from the group consisting of Si, W, Al, Ti, TiN, and CoSi is within the range of from about 50:1 to about 4:1.

5. An etching method in a semiconductor processing comprising:

dry etching an oxide using a plasma;

ashing the etched oxide to remove an organic material; and supplying an organic stripping composition to remove residues including any residual organic material, a metal polymer, and an oxide type polymer, the organic stripping composition comprising a first compound including a hydroxyl ion ($OH^-$), a second compound including a fluorine ion ($F^-$) and a sufficient amount of nitric acid and a mixture of:

75–86% by volume of dimethylacetamide;

5–15% by volume of water; and

2–15% by volume of acetic acid, ammonium hydroxide, and hydrofluoric acid, wherein the ratio of nitric acid to the mixture ranges from about 1:200 to about 1:250, to control the pH of the composition within the range of from about 6.5 to about 8.0.

6. The etching method as claimed in claim 5, wherein a silicon layer is exposed by the etching.

7. The etching method as claimed in claim 5, wherein at least one layer comprising a material selected from the group consisting of W, Al, Ti, TiN and CoSi is exposed by the etching.

8. The etching method as claimed in claim 5, wherein the composition comprises acetic acid, ammonium hydroxide, hydrogen fluoride and the oxidizing agent and the pH of the composition is within the range of from about 6.5 to about 7.0.

9. The organic stripping composition as claimed in claim 3, wherein the amount of hydrofluoric acid is less than 1% by weight, based on the total weight of the composition.

* * * * *